US010731665B2

(12) United States Patent
Ichigaya

(10) Patent No.: US 10,731,665 B2
(45) Date of Patent: Aug. 4, 2020

(54) SHEET HAVING FAN-MOUNTING PART

(71) Applicant: SFT LABORATORY CO., LTD., Itabashi-ku, Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 339 days.

(21) Appl. No.: 15/122,921

(22) PCT Filed: Mar. 18, 2014

(86) PCT No.: PCT/JP2014/057357
§ 371 (c)(1),
(2) Date: Aug. 31, 2016

(87) PCT Pub. No.: WO2015/140926
PCT Pub. Date: Sep. 24, 2015

(65) Prior Publication Data
US 2017/0067484 A1 Mar. 9, 2017

(51) Int. Cl.
*F04D 29/60* (2006.01)

(52) U.S. Cl.
CPC ..... *F04D 29/601* (2013.01)

(58) Field of Classification Search
CPC ... F04D 29/601; A41D 1/002; A41D 13/0025; A41D 13/0053
See application file for complete search history.

(56) References Cited

U.S. PATENT DOCUMENTS 2,826,758 A * 3/1958 Kahn ..... A41D 13/0025 2/81
6,692,226 B1 2/2004 Cheng
7,272,946 B2 * 9/2007 Ichigaya ..... A41D 13/0025 62/259.3

(Continued)

FOREIGN PATENT DOCUMENTS

JP 06033756 U 5/1994
JP 09156440 A 6/1997

(Continued)

OTHER PUBLICATIONS

WO 2006090677 Translation.*
JP-11324531, Tanabe et al. (Nov. 1999) Foreign Reference and Translated Abstract.*
Extended European Search Report (EESR) dated Mar. 6, 2017, issued in counterpart European Application No. 14886000.0.

(Continued)

*Primary Examiner* — Kenneth J Hansen
*Assistant Examiner* — Aye S Htay
(74) *Attorney, Agent, or Firm* — Holtz, Holtz & Volek PC

(57) ABSTRACT

A sheet having a fan-mounting part for mounting a fan is provided. The fan includes a fan body including a cylinder part and a protrusion which is disposed on the cylinder part protruding in a direction substantially perpendicular to a side face of the cylinder part and an engaging member which is fitted on an outer side of the cylinder part and is thus attached to the fan body so as to be opposite the protrusion. The sheet having the fan-mounting part includes a sheet member and a non-stretchable flat ring-shaped reinforcing section. The sheet member has an open hole for receiving the cylinder part of the fan. The reinforcing section has an opening with substantially the same shape as an outer edge of the cylinder part of the fan.

6 Claims, 12 Drawing Sheets

(56) References Cited

U.S. PATENT DOCUMENTS

| | | | | |
|---|---|---|---|---|
| 2007/0050878 | A1* | 3/2007 | Ichigaya | A41D 13/0025 2/69 |
| 2010/0242147 | A1* | 9/2010 | Pohr | A41D 13/0025 2/69 |
| 2016/0270457 | A1* | 9/2016 | Chen | A41D 13/0025 |
| 2017/0135419 | A1* | 5/2017 | Ichigaya | A41D 13/0025 |

FOREIGN PATENT DOCUMENTS

| | | | | |
|---|---|---|---|---|
| JP | 11324531 | A | * | 11/1999 |
| JP | 2005054299 | A | | 3/2005 |
| JP | 4399765 | B2 | | 1/2010 |
| WO | 2006009108 | A1 | | 1/2006 |
| WO | 2006090677 | A1 | | 8/2006 |

OTHER PUBLICATIONS

International Search Report (ISR) dated Jun. 17, 2014 issued in International Application No. PCT/JP2014/057357.

International Preliminary Report on Patentability dated Feb. 2, 2015, issued in counterpart International Application No. PCT/JP2014/057357.

Chinese Office Action dated Feb. 13, 2018 issued in counterpart Chinese Application No. 201480077240.X.

Japanese Office Action dated Feb. 6, 2018 issued in counterpart Japanese Application No. 2016-508371.

Chinese Office Action (and English language translation thereof) dated Oct. 18, 2018 issued in counterpart Chinese Application No. 201480077240.X.

* cited by examiner

SHEET HAVING FAN-MOUNTING PART

TECHNICAL FIELD

The present invention relates to a sheet having a fan-mounting part for mounting a fan on a sheet member such as fabric, which is used for, for example, air-flow mats, A/C (air-conditioned) cloths and the like that evaporate sweat from a human body by an air flow.

BACKGROUND ART

In recent year, air-flow mats and A/C cloths that evaporate sweat from a human body by an air flow have been put into practice (e.g. see Patent Document 1 and Patent Document 2). For example, an A/C cloth is de of a material that is less permeable to the air, and two fan-mounting parts for mounting fans are provided in the lower back part of the A/C cloth. By mounting fans to the fan-mounting parts and powering them, a large amount of fresh air is taken from the outside into the A/C cloth. The fresh air taken in the A/C cloth flows upward parallel to the human body and is then discharged from, for example, holes of a collar and cuffs. While flowing inside the A/C cloth, the fresh air evaporates sweat from the human body. The body surface temperature can thus be decreased due to the heat of the evaporation (e.g. see Patent Document 3).

Next, a method for producing an A/C cloth will be described. In the following description, an A/C working cloth is taken as an example of an A/C cloth. Prior to the description, a method for producing a typical working cloth is briefly described. To produce a typical working cloth, first, the fabric parts thereof are prepared by cutting fabric according to a pattern of the working cloth. A typical working cloth requires approximately as many as a dozen of fabric parts. Then, a fastener, buttons and the like are attached to predetermined fabric parts. Thereafter, the fabric parts are sewn together into the typical working cloth.

A major difference between a method for producing an A/C cloth and a method for producing a typical working cloth is that the method for producing an A/C cloth involves a step of providing a fan-mounting part for mounting a fan to a fabric part that corresponds to the lower back part of the A/C cloth. As used herein, a sheet having a fan-mounting part refers to a sheet member such as fabric or a fabric part in which a fan-mounting part is provided. There are basically two methods for producing an A/C cloth. One method is to directly form a fan-mounting part in a fabric part itself that corresponds to the lower back part of an A/C cloth. The other method involves forming a sheet having a fan-mounting part beforehand in which the fan-mounting part is provided not in a fabric part of an A/C cloth but in a sheet member such as a small fabric, and sewing it to a fabric part that corresponds to the lower back part of the A/C cloth. In the following description, the former method is referred to as an own-sheet method, and the latter method as a separate-sheet method.

The own-sheet method requires forming the fan-mounting part in the fabric part in a sewing site, while the outer appearance provokes a less sense of inconsistency since the fabric part is a part of the fabric of the A/C cloth itself. In contrast, the separate-sheet method allows mass production of the sheet having a fan-mounting part in a different place other than a sewing site, for example, by using a rectangular fabric with an adequate size according to the size of the fan. The mass-produced sheet having the fan-mounting part allows normal sewing factories to produce the A/C cloth without any equipment or skill required for processing the fan-mounting part. From an economic viewpoint, it is not rational to use the same fabric as that of the A/C cloth itself, but it is desirable to use fabric of a different material. In such cases, since the fabric of the A/C cloth is different from the fabric of the sheet having the fan-mounting part, the outer appearance may provoke a sense of inconsistency. However, it is advantageous in the production cost.

In almost all A/C cloths, fans are attached in two locations in the back part. However, since such fans cool the low back too much and are disturbing when driving a car or the like, it has been often required to attach fans right in the sides of the body part. FIG. 12 is a schematic side view of a typical working cloth. In a typical working cloth, fabric parts 200 are sewn together right in the sides as illustrated in FIG. 12. In the figure, seams 210 formed by the sewing are illustrated by the dashed lines. Similar to typical working cloths, fabric parts 200 are sewn together right in the sides of A/C cloths. Therefore, it is difficult to form fan-mounting parts in the sewn parts by the own-sheet method. In contrast, it is possible to attach fans right in the sides by the separate-sheet method since the sheets having the fan-mounting part can be readily attached over adjacent fabric parts 200.

No matter which method is used for producing an air-flow mat or an A/C cloth between the own-sheet method and the separate-sheet method, it is required to firmly attach the fan to the sheet member so that the air does not leak through the fan-mounting part in order to improve the air-conditioning performance. On the other hand, it is required that the fan is readily detachable from the sheet member by a user for washing the air-flow mat or the A/C cloth.

For this reason, it is desirable to use a fan having the structure as disclosed in FIG. 12 of Patent Document 2 for A/C cloths and the like. Such fans include a fan body and a ring engaging member for mounting the fan body on a sheet member. The fan body includes a hollow cylinder part and a flange part that protrudes from the upper end of the cylinder part in a direction approximately perpendicular to the side face of the cylinder part. The fan is mounted on the sheet member by fitting the ring engaging member on the outer side of the cylinder part and thereby tucking the edge part around an open hole of the sheet member between the underside of the flange part and the end face of the ring engaging member opposed to the flange part and engaging an engaging piece formed in the cylinder part with a protrusion formed in the ring engaging member.

If the fan-mounting part is constituted by only the sheet member with an open hole for mounting the fan, the fan readily comes off from the sheet member due to a great force applied to the fan since the sheet member used in A/C cloths and the like is stretchable. To avoid this, the Patent Document 2 proposes to use the fan-mounting part that has an open hole for mounting the fan and includes a non-stretchable material disposed in the edge part around the open hole of the sheet member. Specifically, the fan-mounting part with the non-stretchable material is produced as follows. First, a hole is formed at a predetermined location in the sheet member, and the part of the sheet member around the hole is folded to the back. Then, a non-stretchable ring material is inserted in the overlapped part of the sheet member that was formed by the folding. Thereafter, a fabric is patched to the back side of the part of the sheet member in which the non-stretchable material is inserted, and the fabric is sewn to the sheet member with a thread. In this way, the open hole is formed, and the non-stretchable material is stitched around the open hole.

PRIOR ART DOCUMENTS

Patent Documents

Patent Document 1: JP 4399765B
Patent Document 2: WO 2006/009108A
Patent Document 3: JP 2005-54299A

SUMMARY OF THE INVENTION

Problem to be Solved by the Invention

However, in the above-described method for forming the fan-mounting part, it is difficult to keep the open hole in a precise circular shape during the steps of folding the part around the hole of the sheet member to the back and inserting the non-stretchable material in the sheet member. Therefore, the steps are laborious. Further, it is required to pay great attention to maintain the shape of the open hole during the steps of patching the fabric to the back side of the part of the sheet member where the non-stretchable material is inserted and sewing the fabric to the sheet member with a thread. Therefore, the steps are not only laborious but also difficult for a beginner worker and can be done only by a skilled worker.

The present invention has been made in view of the above-described circumstances, and an object thereof is to provide a sheet having a fan-mounting part which can be readily produced by forming the fan-mounting part in the sheet member.

Means for Solving the Problem

To achieve the above-described object, there is provided a sheet having a fan-mounting part for mounting a fan which comprises a fan body including a cylinder part and a protrusion which is disposed on the cylinder part protruding in a direction substantially perpendicular to a side face of the cylinder part and an engaging member which is fitted on an outer side of the cylinder part and is thus attached to the fan body so as to be opposite the protrusion, including:

- a sheet member which has an open hole for receiving the cylinder part of the fan; and
- a non-stretchable flat ring-shaped reinforcing section which has an opening with substantially the same shape as an outer edge of the cylinder part of the fan, in which one of a front face and a back face of the reinforcing section is fixed on an edge part around the open hole of the sheet member, and an inner side face of the reinforcing section is exposed,
- wherein the fan is mounted by inserting the cylinder part to the opening of the reinforcing section and attaching the engaging member to the fan body and thereby tucking at least an edge part of the reinforcing section among an edge part around the open hole of the sheet member and the edge part of the reinforcing section between the protrusion and the engaging member.

In the above-described configuration of the present invention, one of the front and the back faces of the reinforcing section is fixed on the edge part around the open hole of the sheet member. Therefore, unlike the prior art, forming the fan-mounting part for mounting a fan in the sheet member does not require the steps of folding the sheet member to the back and then inserting a reinforcing section to the folded part of the sheet member and patching a back fabric to the part of sheet member. That is, the fan-mounting part can be readily formed in the sheet member. Further, the non-stretchable reinforcing section can reinforce the edge part around the open hole of the sheet member by restricting the edge part from being stretched or shrunk. Therefore, even when a great force is applied between the fan and the reinforcing section or between the fan and the sheet member, the fan is less likely to come off from the fan-mounting part. Further, the inner side face of the reinforcing section is exposed. Therefore, when only one of the front and the back faces of the reinforcing section is fixed on the edge part of the sheet member, the remaining faces of the reinforcement other than the face fixed on the edge part of the sheet member are not covered with the sheet member but are exposed, and the inner side face of the reinforcing section serves as the inner side face of the fan-mounting part for mounting the fan. As a result, it is possible to form the fan-mounting part having precise size and shape by forming the reinforcing section having precise shape and size.

Effects of the Invention

In the sheet having a fan-mounting part of the present invention, the fan-mounting part can be readily formed in the sheet member. Further, even when a great force is applied between the fan and the reinforcing section or between the fan and the sheet member, the fan is less likely to come off from the fan-mounting part of the sheet.

EMBODIMENTS FOR CARRYING OUT THE INVENTION

Figure 1A:
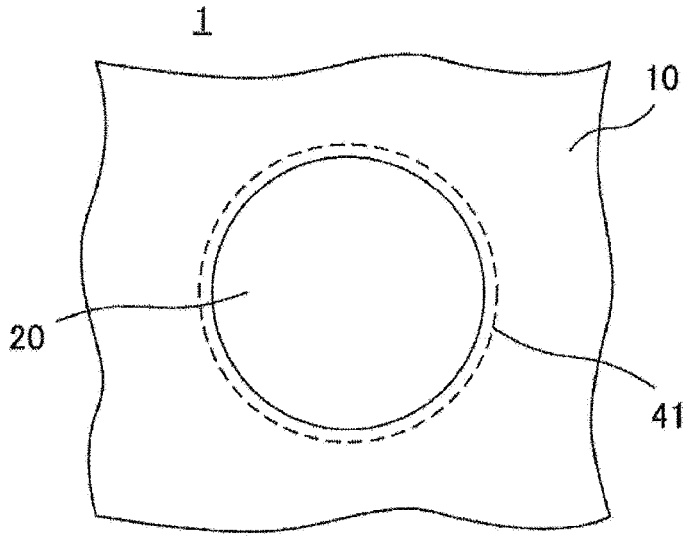
FIG. 1 (*a*) is a schematic front face view of a sheet having a fan-mounting part according to a first embodiment of the present invention, FIG. 1 (*b*) is a schematic back face view of the sheet having the fan-mounting part, and FIG. 1 (*c*) is a schematic partial cross sectional view of the sheet having the fan-mounting part taken in the direction of the arrowed line A-A.

Hereinafter, embodiments for carrying out the invention of the present application will be described referring to the drawings.

First Embodiment

Figure 1B:
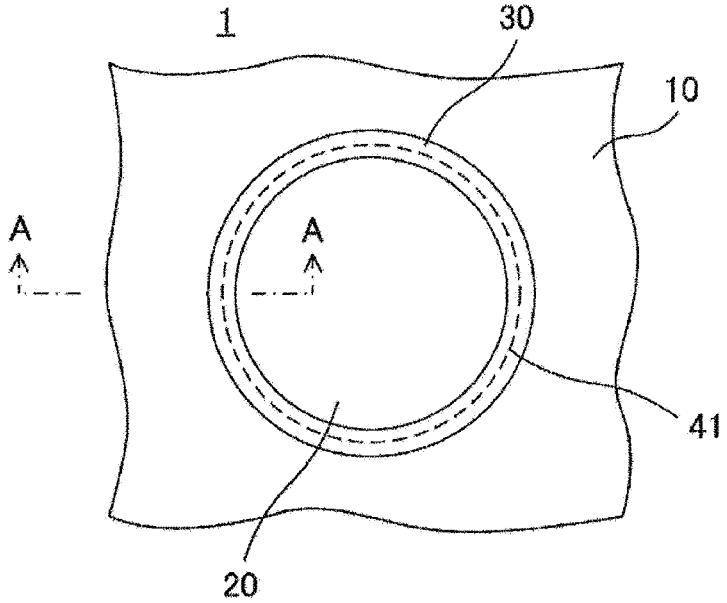
Figure 1C:
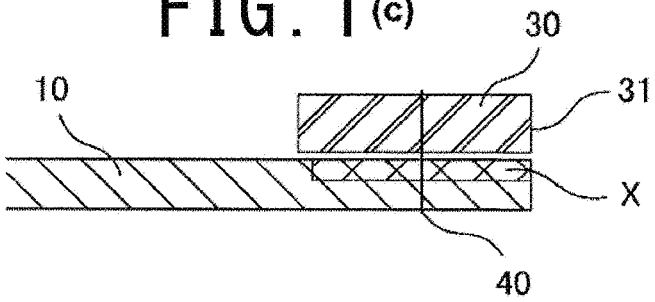
Figure 2:
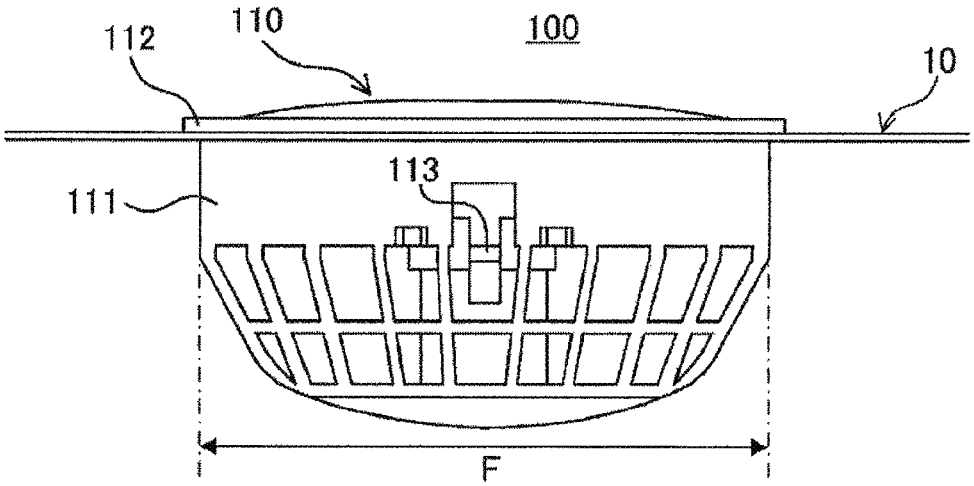
FIG. 2 (*a*) is a schematic side view of a fan for an air-flow mat or an A/C cloth which is inserted in an open hole of the sheet having the fan-mounting part according to the first embodiment, FIG. 2 (*b*) is a schematic side view of a ring engaging member of the fan, and FIG. 2 (*c*) is a schematic side view of the fan which is mounted on the fan-mounting part.
Figure 2:
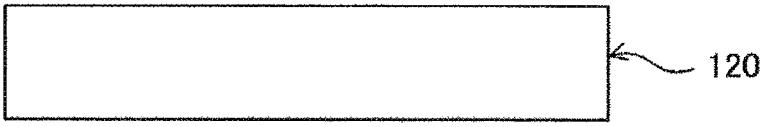
Figure 2:
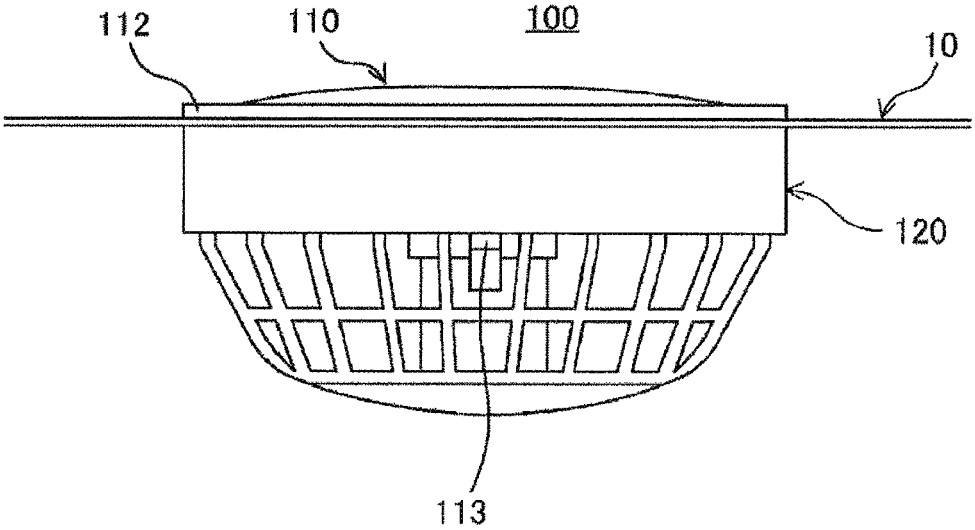
Figure 3:
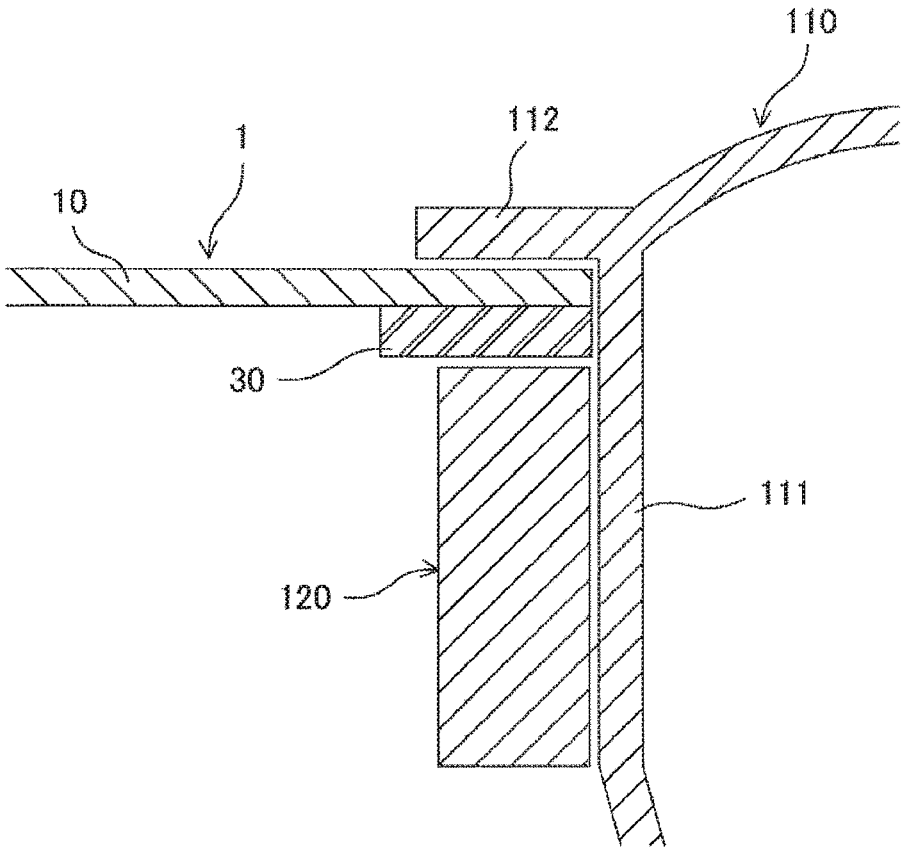
FIG. 3 is a schematic partial cross sectional view of the fan which is mounted on the fan-mounting part.

First, a first embodiment of the present invention will be described referring to the drawings. FIG. 1 (*a*) is a schematic front face view of a sheet having a fan-mounting part according to the first embodiment of the present invention, FIG. 1 (*b*) is a schematic back face view of the sheet having the fan-mounting part, and FIG. 1 (*c*) is a schematic partial cross sectional view of the sheet having the fan-mounting part taken in the direction of the arrowed line A-A. FIG. 2 (*a*) is a schematic side view of a fan for an air-flow mat or an A/C cloth, which is inserted in an open hole of the sheet having the fan-mounting part according to the first embodiment, FIG. 2 (*b*) is a schematic side view of a ring engaging member of the fan, and FIG. 2 (*c*) is a schematic side view of the fan which is mounted on the fan-mounting part. FIG. 3 is a schematic partial cross sectional view of the fan which is mounted on the fan-mounting part.

In the sheet having the fan-mounting part of the first embodiment, the fan-mounting part, which is used for mounting a fan of an air-flow mat, an A/C cloth or the like that evaporates sweat from the human body by an air flow, is formed in a predetermined sheet member. As illustrated in FIG. 1, the sheet having the fan-mounting part 1 includes a sheet member 10, an open hole 20 and a non-stretchable flat ring-shaped reinforcement (reinforcing section) 30. The sheet member 10 serves as a base in which the fan-mounting part is formed. The fan-mounting part is composed of the open hole 20, the edge part around the open hole 20 of the sheet member 10 and the reinforcement 30.

The sheet having the fan-mounting part 1 of the first embodiment is used in producing an A/C cloth or the like by the own-sheet method. Accordingly, the sheet member 10 is cut from the same fabric as that of the A/C cloth itself. For example, the sheet member 10 is made of normal woven fabric. The sheet member 10 has front and back sides. That is, the front face of the sheet member 10 corresponds to the outer side of the A/C cloth produced with the sheet having the fan-mounting part 1, and the back face of the sheet member 10 corresponds to the inner side of the A/C cloth. Similar to the front-back positional relationship of the sheet member 10, a face at the same side as the front face of the sheet member 10 is also referred to as a front face, and a face at the same side as the back face of the sheet member 10 is also referred to as a back face.

A fan 100 used in an air-flow mat, an A/C cloth or the like will be briefly described. As illustrated in FIG. 2, the fan 100 includes a fan body 110 in which a motor and an impeller are housed and a ring engaging member 120 attached to the fan body 110. The fan body 110 includes a cylinder part 111 and a flange part 112 that protrudes from the upper end of the cylinder part 111 in a direction approximately perpendicular to the side face of the cylinder part 111. The cylinder part 111 has a circular outer cross section taken along a plane perpendicular to the center axis thereof. The outer diameter F of the cylinder part 111 is 64.5 mm. The engaging member 120 is a dedicated part for mounting the fan body 110 on the fan-mounting part of the sheet having the fan-mounting part 1. On the cylinder part 111 of the fan body 110, two engaging hooks 113 are provided. On the inner face of the engaging member 120, protrusions (not shown) are provided, which engage with the engaging hooks 113 to fix the engaging member 120 on the outer surface of the cylinder part 111. By fitting the engaging member 120 on the outer side of the cylinder part 111 and engaging it with the fan body 110, the engaging member 120 can be readily attached to the fan body 110 opposite the flange part 112.

The open hole 20 of the sheet having the fan-mounting part 1, which is provided for receiving the cylinder part 111 of the fan 100, is formed in a predetermined location in the sheet member 10. In the first embodiment, the open hole 20 has a circular shape as illustrated in FIG. 1 (*a*) and FIG. 1 (*b*). The diameter of the open hole 20 is approximately equal to or greater than the outer diameter F of the cylinder part 111. In the first embodiment, the open hole 20 formed in the sheet member has a diameter approximately equal to the outer diameter F of the cylinder part 111.

The reinforcement 30 has a flat ring shape that has an opening with approximately the same shape as the outer edge of the cylinder part 111 of the fan 100. In the first embodiment, the reinforcement 30 has a circular ring shape with an inner diameter (a diameter of the opening) approximately equal to the outer diameter F of the cylinder part 111 as illustrated in FIG. 1 (*b*). Accordingly, the inner diameter of the reinforcement 30 is approximately equal to the diameter of the open hole 20. The reinforcement 30 is made of a material that is washable, sewable and not so stretchable. Specifically, the material can be selected from plastic, resin-impregnated fabric, artificial leather and non-stretchable rubber. Particularly in the first embodiment, the reinforcement 30 is made of polypropylene and has a thickness of 0.5 mm, an inner diameter of 65 mm, an outer diameter of 73 mm and a width of 4 mm. In practice, the reinforcement 30 can be readily produced with high precision by punching a polypropylene sheet. Further, the reinforcement 30 is opaque.

The reinforcement 30 is fixed on the back face of the sheet member 10 in the edge part around the open hole 20 of the sheet member 10. That is, the front face of the reinforcement 30 is fixed on the edge part around the open hole 20 of the sheet member 10. Specifically, the reinforcement 30 is fixed on the sheet member 10 by sewing the reinforcement 30 to the edge part around the open hole 20 of the sheet member 10 with a thread 40. In FIG. 1 (*a*) and FIG. 1 (*b*), a seam 41 that is formed by the sewing work is illustrated by the dashed line. Further, the reinforcement 30 is sewn to the sheet member 10 in a circular shape approximately along the center of the reinforcement 30. Among the faces of the reinforcement 30, the faces other than the face fixed on the edge part of the sheet member 10 are not covered with the sheet member 10 but are exposed. Accordingly, the inner side face 31 of the reinforcement 30 is exposed as illustrated in FIG. 1 (*c*).

The relationship between the inner and outer diameters of the reinforcement 30 and the diameter of the open hole 20 is described. Typically, the diameter of the open hole 20 is approximately equal to or greater than the inner diameter (diameter of the opening) of the reinforcement 30. When the diameter of the open hole 20 is greater than the inner diameter of the reinforcement 30, the outer diameter of the reinforcement 30 have to be greater than the diameter of the open hole 20. This is because the reinforcement 30 is required to be attached to the edge part around the open hole 20 of the sheet member 10. As described above, in the first embodiment, the open hole 20 that is formed in the sheet member 10 has a diameter approximately equal to the inner diameter of the reinforcement 30. Accordingly, when the reinforcement 30 is fixed on the edge part around the open hole 20 of the sheet member 10, the whole under side (front face) of the reinforcement 30 is in contact with the edge part around the open hole 20 of the sheet member 10 as illustrated in FIG. 1 (*c*), so that the reinforcement 30 is not visible from the outer side of the sheet member 10 as illustrated in FIG. 1 (*a*).

It is required to strengthen the fabric in the edge part around the open hole 20 of the sheet member 10. When two sheets of woven fabric are sewn together for example, a force may be applied to the two sheets of woven fabric in a direction of separating the two sheets of woven fabric during use. To address this, the sewn part of the two sheets of woven fabric is required to have a sufficient strength according to an intended use. In practice, in the case where two sheets of woven fabric are simply overlaid with each other and sewn together, when a force is applied to the sewn part in the direction of separating the two sheets of woven fabric, the threads at the edge side relative to the sewn part are frayed, and the two sheets of woven fabric are easily separated from each other. A general technique to avoid this is, for example, to fold the edge part of each of two sheets of woven fabric to double and to overlay and sew the doubled parts of the two sheets of woven fabric with each other. Even when one of the members to be sewn together is a fabric and the other is a non-frayable material, it is required to strengthen the fabric. Accordingly, when two members including at least one fabric member are sewn together, strengthening a fabric means both providing a sufficient strength to the sewn two members and preventing a fabric member from fraying.

In the sheet having fan-mounting part 1 of the first embodiment, the fabric is strengthened in the back face of the sheet member 10 in a part X around the open hole 20 of the sheet member 10 by utilizing the anchor effect as illustrated in FIG. 1 (*c*). Specifically, a predetermined resin is welded to the part X around the open hole 20 of the sheet member 10. This can improve the strength of the part X of the sheet member 10 and also prevent fray. Then, the inner edge of the reinforcement 30 is precisely aligned with the open hole 20, and the reinforcement 30 is integrated with the edge part around the open hole 20 of the sheet member 10 by sewing them together in a circular shape with the thread 40 as illustrated in FIG. 1 (*a*) and FIG. 1 (*b*).

To mount the fan 100 on the sheet having the fan-mounting part 1 of the first embodiment, the cylinder part 111 of the fan body 110 is inserted in the opening of the reinforcement 30 so that the underside of the flange part 112 is in contact with the edge part around the open hole 20 of the sheet member 10 as illustrated in FIG. 2 (*a*). Then, the engaging member 120 is attached to the fan body 110 by fitting the engaging member 120 on the outer side of the cylinder part 111 and thereby tucking the edge part around the open hole 20 of the sheet member 10 and the edge part of the reinforcement 30 between the underside of the flange part 112 and the upper face of the engaging member 120 and engaging the protrusions of the engaging member 120 with the engaging hooks 113 of the cylinder part 111 as illustrated in FIG. 3. The fan 100 is thus mounted on the fan-mounting part as illustrated in FIG. 2 (*c*). When the fan 100 is mounted on the fan-mounting part, the reinforcement 30 is in direct contact with the engaging member 120, and the inner side face 31 of the reinforcement 30 is in direct contact with the outer side face of the cylinder part 111.

Next, a method for producing the sheet having the fan-mounting part 1 of the first embodiment will be described.

Figure 4:
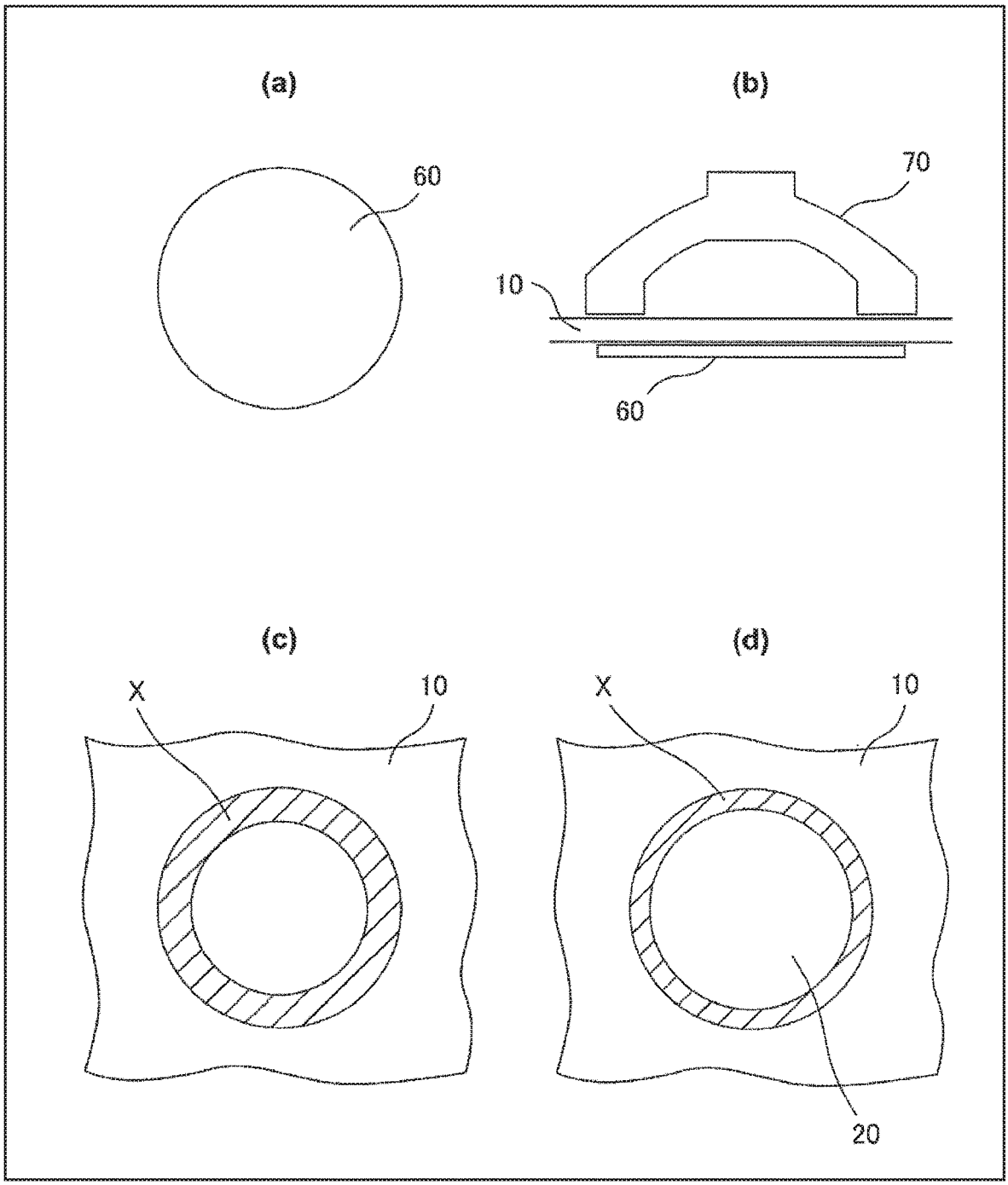
FIG. 4 illustrates first and second steps of a method for producing the sheet having the fan-mounting part according to the first embodiment.
Figure 5:
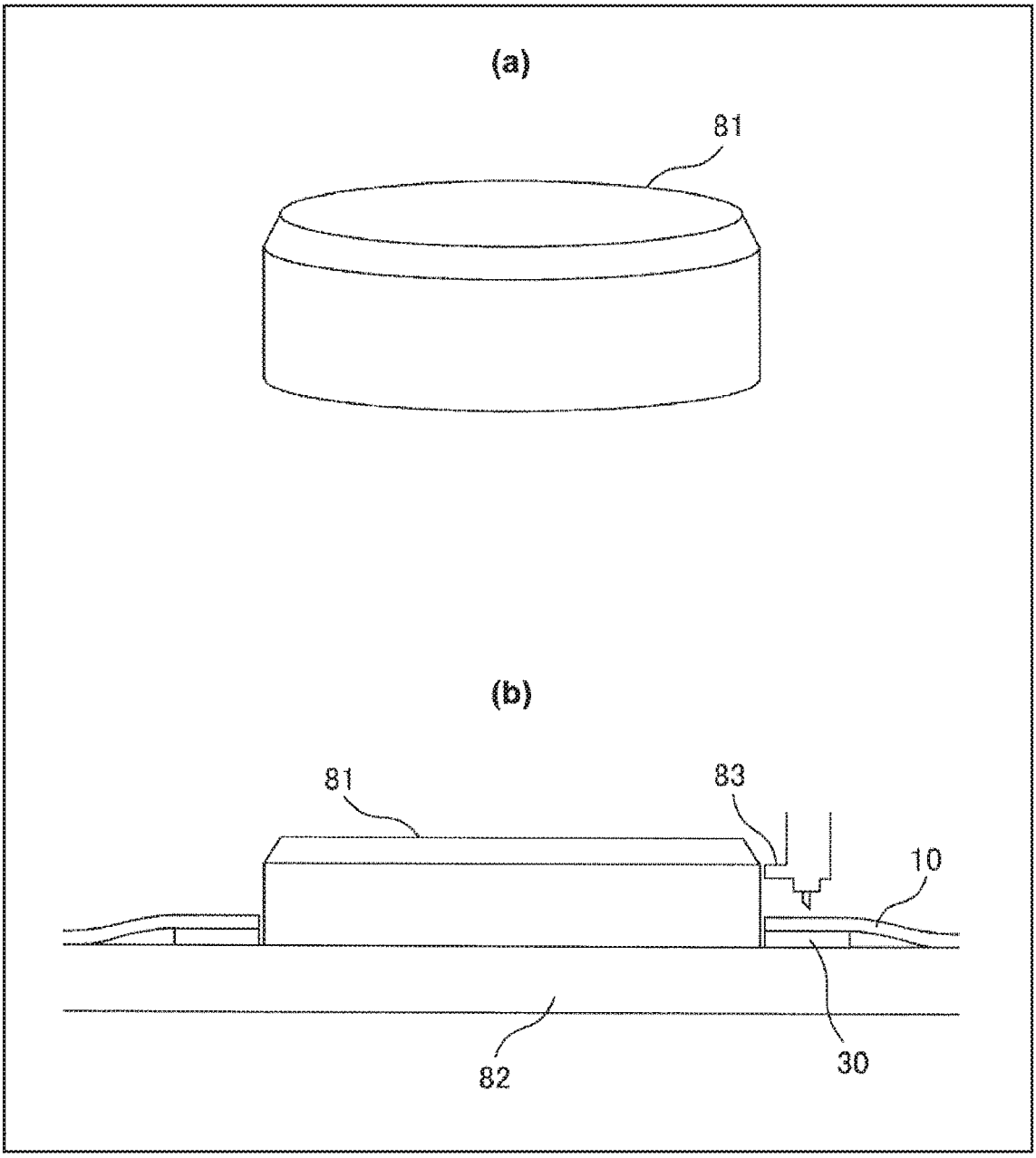
FIG. 5 illustrates a third step of the method for producing the sheet having the fan-mounting part.

The method for producing the sheet having the fan-mounting part 1 of the first embodiment involves a first step of strengthening the fabric in a predetermined part of the sheet member 10, a second step of forming the open hole 20 in the sheet member 10 and a third step of sewing the reinforcement 30 to the sheet member 10. FIG. 4 illustrates the first and second steps of the method for producing the sheet having the fan-mounting part 1 of the first embodiment, and FIG. 5 illustrates the third step of the method for producing the sheet having the fan-mounting part 1.

Before the first step, a circular strengthening sheet 60 as illustrated in FIG. 4 (*a*) is prepared. The strengthening sheet 60 is made of polypropylene and has a diameter of 75 mm and a thickness of 0.2 mm. In the first step, the strengthening sheet 60 is disposed under the sheet member 10 as illustrated in FIG. 4. (*b*).

Then, a horn 70 with a ring pressing face of an ultrasonic welder is pressed against the sheet member 10 in such a manner that the center axis thereof is aligned with the center axis of the strengthening sheet 60 as illustrated in FIG. 4 (*b*). The inner diameter of the horn 70 of the ultrasonic welder is less than the outer diameter F of the cylinder part 111. Further, the outer diameter of the horn 70 is desirably greater than the diameter of the strengthening sheet 60. Thereafter, the horn 70 is operated to generate ultrasonic vibration. Then, the part of the strengthening sheet 60 corresponding to the horn 70 is melted or softened and bites into the back face of the sheet member 10. The polypropylene resin is thus welded to the predetermined part in the back face of the sheet member 10, and the strength of the part is therefore improved. FIG. 4 (*c*) is a view of the sheet member 10 from the back face side thereof, in which the ring part X to which the polypropylene resin is welded, i.e. where the fabric is strengthened, is indicated by a diagonal hatching.

Then, in the second step, the strengthened part X is cut as illustrated in FIG. 4 (*d*) by means of a cutting machine with a cutting blade having a diameter approximately equal to the outer diameter F of the cylinder part 111, so that the open hole 20 is formed in the sheet member 10. As a result, the width of the part X is reduced. Since polypropylene resin is welded to the strengthened part X, the threads in the cutting surface do not fray.

Then, in the third step, the reinforcement 30 is sewn to the sheet member 10 by means of a sewing machine. A predetermined sewing jig is used in the sewing work of the third step. The sewing jig 81 is formed in approximately a cylindrical shape as illustrated in FIG. 5 (*a*). The outer diameter of the sewing jig 81 is approximately equal to the inner diameter of the reinforcement 30. Further, the top part of the sewing jig 81 is chamfered. In the third step, the sewing jig 81 is mounted on a table 82 of the sewing machine as illustrated in FIG. 5 (*b*). Then, the reinforcement 30 is fitted on the sewing jig 81. Thereafter, the sheet member 10 is fitted on the sewing jig 81 with the face to which polypropylene resin was welded down. The reinforcement 30 and the sheet member 10 are thus overlaid with each other. Then, as illustrated in FIG. 5 (*b*), while a presser foot pillar 83 of the sewing machine is placed in contact with the side wall of the sewing jig 81 at a right angle, the reinforcement 30 is sewn to the sheet member 10 in a circular shape by means of the sewing machine. The sheet having the fan-mounting part 1 of the first embodiment is thus produced.

The above-described first step is an example in which the fabric is strengthened by welding resin to the sheet member 10. Alternatively, for example, the fabric may be strengthened by applying commercially available fray stopper to the sheet member 10. Further, when the sheet member 10 is made of, for example, a laminated material that does not fray and has sufficient strength against sewing, such as a material used in rainwears, the first step of strengthening the fabric in the predetermined part of the sheet member 10 can be omitted.

In the sheet having the fan-mounting part of the first embodiment, the reinforcement is fixed on the edge part around the open hole of the sheet member. Unlike the prior art, the production of the sheet having the fan-mounting part does not require the steps of folding back the sheet member and then inserting a reinforcement to the folded part of the sheet member and patching a back fabric to the part of the sheet member. Therefore, the fan-mounting part can be readily formed in the sheet member. Further, the non-stretchable reinforcement reinforces the edge part around the open hole of the sheet member so that the edge part does not stretched or shrunk. Therefore, even when a great force is applied between the fan and the reinforcement or between the fan and the sheet member, the fan is less likely to come off from the fan-mounting part of the sheet. Further, since the faces of the reinforcement other than the face fixed on the edge part of the sheet member are not covered with the sheet member but are exposed, the inner side face of the reinforcement serves as the inner side face of the fan-mounting part. Therefore, it is possible to form the fan-mounting part having precise size and shape by forming the reinforcement having precise size and shape.

In the sheet having the fan-mounting part of the first embodiment, the front face of the reinforcement is fully covered with the sheet member. Therefore, the reinforcement is not visible from the outside when the fan is detached from the fan-mounting part, which keeps the good appearance of an A/C cloth or the like. Further, the fabric is strengthened in the back face of the sheet member in the part around the open hole of the sheet member by utilizing the anchor effect. This can effectively prevent fray in the part. Further, the reinforcement is sewn to the strengthened part of the sheet member. Therefore, the reinforcement can be firmly attached to the sheet member.

Figure 6:
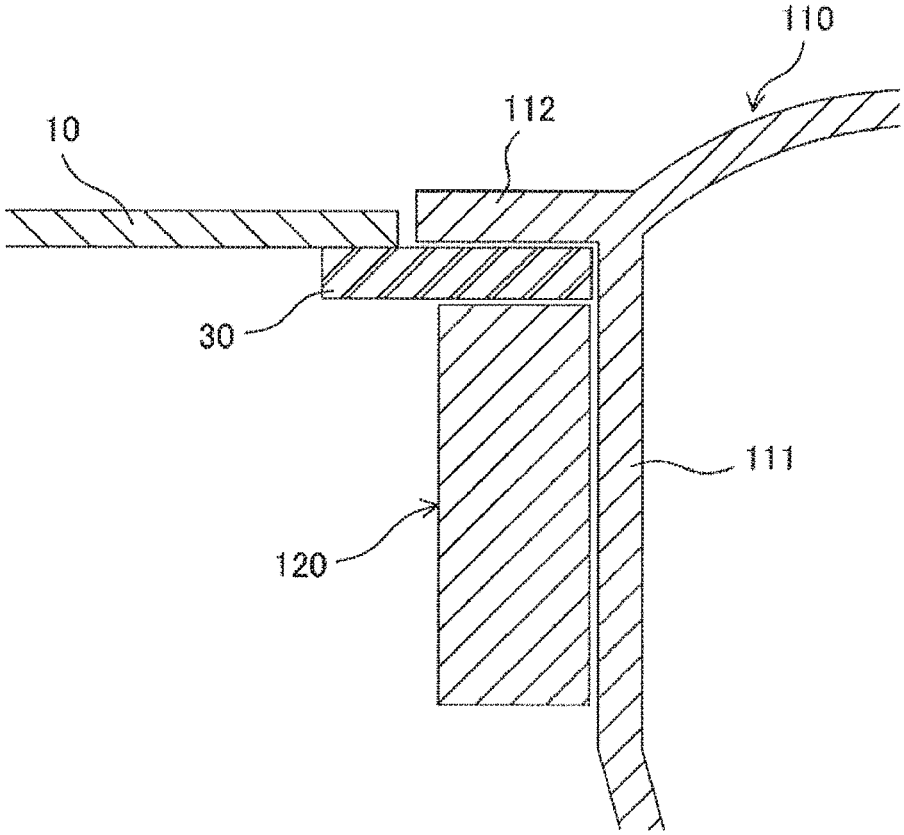
FIG. 6 is a schematic partial cross sectional view of a fan according to a variation of the first embodiment which is mounted on a fan-mounting part.

The above-described first embodiment is an example in which the open hole formed in the sheet member has a diameter approximately equal to the inner diameter of the reinforcement, and the front face of the reinforcement is fully covered with the sheet member. However, the diameter of the open hole may be greater than the inner diameter (diameter of the opening) of the reinforcement. FIG. 6 is a schematic partial cross sectional view of a fan which is mounted on a fan-mounting part according to a variation of the first embodiment. In this case, only a part of the upper face (front face) of a reinforcement. 30 is covered with a sheet member 10 as illustrated in FIG. 6. When the fan 100 is mounted on the fan-mounting part, only the edge part around the open hole 20 of the reinforcement 30 is tucked between the underside of a flange part 112 and the upper face of an engaging member 120.

Second Embodiment

Figure 7:
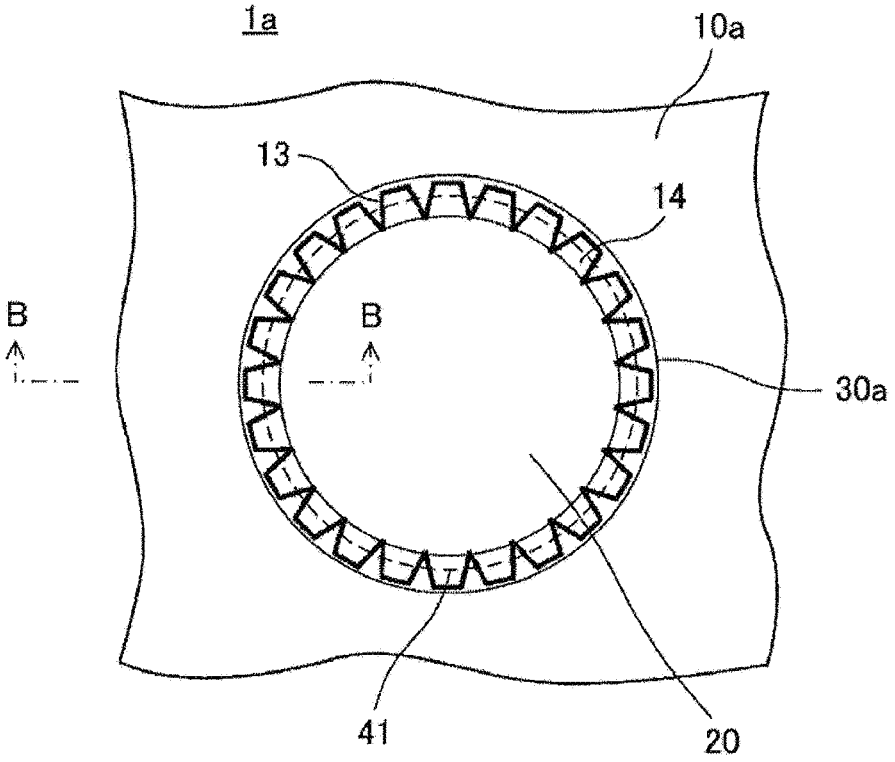
FIG. 7 (*a*) is a schematic back face view of a sheet having a fan-mounting part according to a second embodiment of the present invention, and FIG. 7 (*b*) is a schematic partial cross sectional view of the sheet having the fan-mounting part taken in the direction of the arrowed line B-B.
Figure 7:
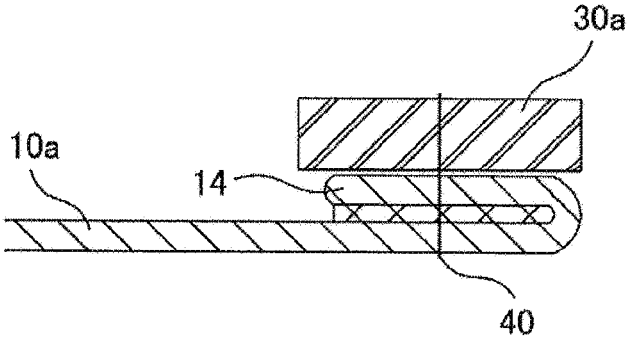

Next, a sheet having a fan-mounting part according to a second embodiment of the present invention will be described. FIG. 7 (*a*) is a schematic back face view of the sheet having the fan-mounting part according to the second embodiment of the present invention, and FIG. 7 (*b*) is a schematic partial cross sectional view of the sheet having the fan-mounting part taken in the direction of the arrowed line B-B. The same reference signs are denoted to components of the second embodiment that have the same function as those of the first embodiment, and the detailed description thereof is omitted.

As illustrated in FIG. 7, the sheet having the fan-mounting part 1*a* of the second embodiment includes a sheet member 10*a*, an open hole 20 and a non-stretchable flat ring-shaped reinforcement (reinforcing section) 30*a*. The sheet having the fan-mounting part 1*a* is mainly used in producing an A/C cloth or the like by the own-sheet method. The sheet having the fan-mounting part 1*a* of the second embodiment is different from the sheet having the fan-mounting part 1 of the first embodiment in that a fray stopper that is used in general sewing works is employed for strengthening the fabric of the sheet member 10*a*, and that a reinforcement 30*a* is transparent. The other configuration is the same as that of the first embodiment.

Specifically, cuts 13 are made in the edge part around the open hole 20 of the sheet member 10*a* as illustrated in FIG. 7 (*b*), and the part with the cuts 13 of the sheet member 10*a* are folded to the back. The parts with the cuts 13 of the sheet member 10*a* are also referred to as "cut parts 14". The cut parts 14 are bonded to the overlapped part of the sheet member 10*a*. In the second embodiment, the edge part around the open hole 20 of the sheet member 10*a* is thus doubled. This improves the strength and also prevents fray. Further, the reinforcement 30*a* is fixed on the back face of the sheet member 10*a* in the edge part (doubled part) around the open hole 20 of the sheet 10*a* as illustrated in FIG. 7 (*b*).

Next, a method for producing the sheet having the fan-mounting part 1*a* of the second embodiment will be described.

Figure 8:
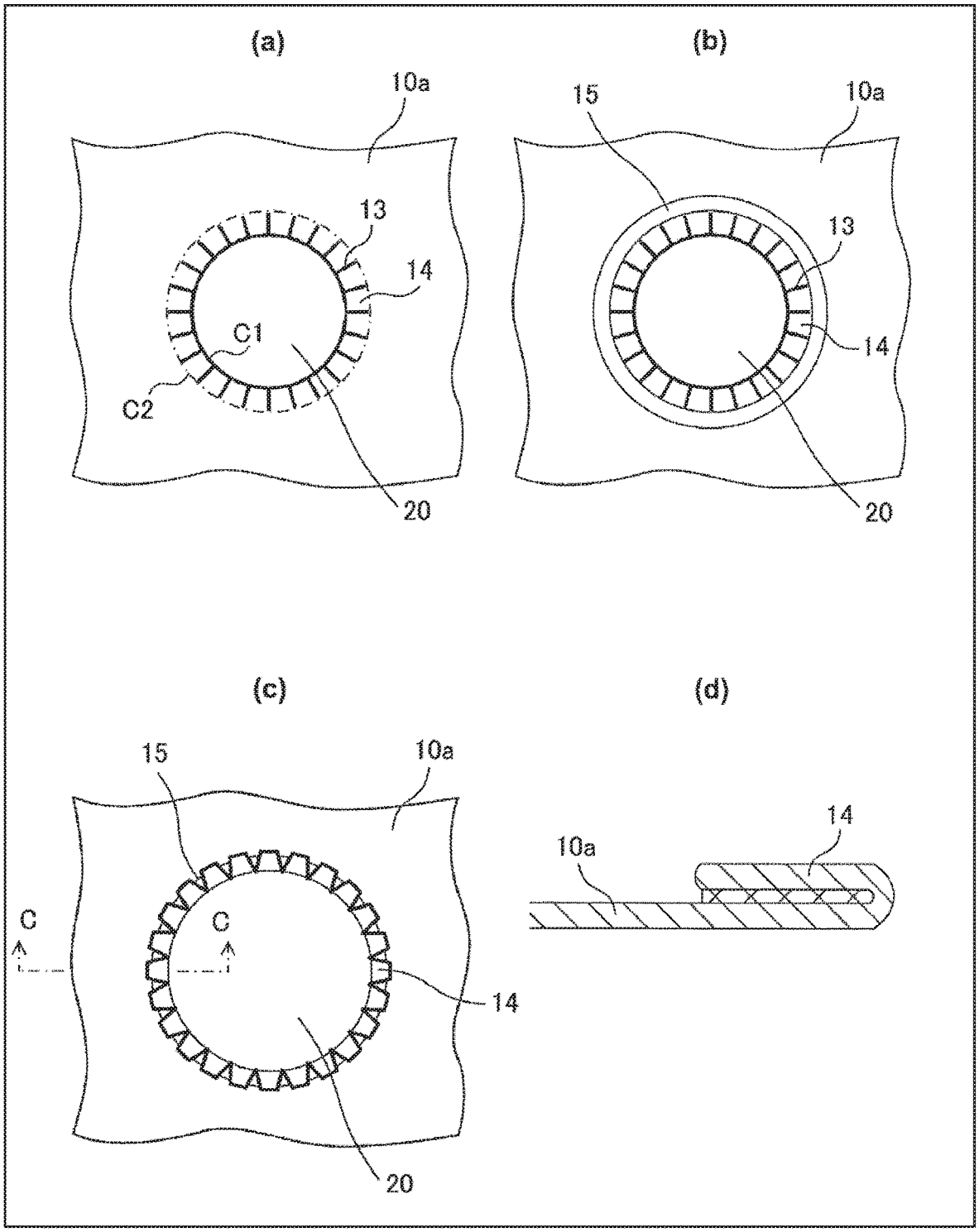
FIG. 8 illustrates first and second steps of a method for producing the sheet having the fan-mounting part according to the second embodiment.

The method for producing the sheet having the fan-mounting part 1*a* of the second embodiment involves a first step of forming the open hole 20 and the cuts 13 in the sheet member 10*a*, a second step of strengthening the fabric in a predetermined part of the sheet member 10*a* and a third step of sewing the reinforcement 30*a* to the sheet member 10*a*. FIG. 8 illustrates the first and second steps of the method for producing the sheet having the fan-mounting part 1*a* according to the second embodiment. FIG. 8 (*d*) is a schematic cross sectional view taken in the direction of the arrowed line C-C in FIG. 8 (*c*).

In the first step, by means of a dedicated cutting machine, the open hole 20 is formed at a predetermined location, in the sheet member 10*a* while a number of cuts 13 are formed in the edge part around the open hole 20 of the sheet member 10*a* as illustrated in FIG. 8 (*a*). In the first step, a 55-mm diameter circular hole is formed as the open hole 20. Further, a number of cuts 13 are formed radially in a ring area of the sheet member 10 between a 55-mm diameter circle C1, which corresponds to the edge of the open hole 20, and a 65-mm diameter circle C2. The ring area is composed of a number of cut parts 14 that are defined by the cuts 13.

The length of the cuts 13 formed in the sheet member 10, which is 65 mm as described above, corresponds to the outer diameter of the cylinder part 111 of the fan 100, which is 64.5 mm. However, since the sheet member 10, which is used in A/C cloths and the like, is stretchable, the value does not define the exact length of the cuts 13. Similarly, numeral values that are used in the description for illustrating the dimension and the like of the sheet member 10 do not define the exact values.

Next, the second step is carried out. Before the second step, a ring adhesion sheet 15 is prepared. The adhesion sheet 15, which is made of polypropylene, has an inner diameter of 65 mm, an outer diameter of 75 mm and a thickness of 0.2 mm. In the second step, the sheet member 10*a* is placed on an ironing board with the back face up. Then, the adhesion sheet 15 is disposed on the sheet member 10*a* so that the center axis thereof is aligned with the center axis of the open hole 20 as illustrated in FIG. 8 (*b*). Thereafter, the cut parts 14 of the sheet member 10*a* are folded onto the adhesion sheet 15 as illustrated in FIG. 8 (*c*). An iron may be used in the folding. By pressing each of the folded cut parts 14 with a tip of an iron, a crease can be formed at the folded part. This can certainly prevent the cut parts 14 from returning to the original shape. Instead of using an iron, the cut parts 14 may be folded mechanically by means of a dedicated machine.

Then, the horn 70 of the same ultrasonic welder as used in the first embodiment is pressed against the part of the sheet member 10*a* corresponding to the folded cut parts 14. By operating the horn 70 to generate ultrasonic vibration, the adhesion sheet 15 is melted so that the cut parts 14 are bonded to the overlapped part of the sheet member 10*a* by the melted adhesion sheet (polypropylene resin) as illustrated in FIG. 8 (*d*). In this way, the edge part around the open hole 20 of the sheet member 10 is doubled. This can improve the strength of the edge part and also prevent fray in the edge part. Further, since the cut parts 14 are folded, the diameter of the open hole 20 is increased from 55 mm to 65 mm in the second step.

As described above, the polypropylene adhesion sheet 15 is used as adhesive for bonding the cut parts 14 to the overlapped part of the sheet member 10*a*. That is, not only the polypropylene adhesion sheet 15, but also a sheet of any material that serves as adhesive can be used as the adhesion sheet. In such cases, not only ultrasonic welding but also any suitable bonding method such as heat welding with a heater can be used according to the material used.

Then, in the third step, the reinforcement 30*a* is sewn to the sheet member 10 by means of a sewing machine. The sewing work in the third step is the same as that in the third step of the first embodiment. In FIG. 7 (*a*), a circular seam 41 that is formed by the sewing work is illustrated by the dashed line. In this way, the sheet having the fan-mounting part 1*a* as illustrated in FIG. 7 is produced.

The sheet having the fan-mounting part of the second embodiment has approximately the same functions and advantageous effects as the sheet having fan-mounting part of the first embodiment. However, the method for producing the sheet having the fan-mounting part of the second embodiment requires the step of folding the edge part around the open hole of the sheet member. In this point, it can be said that the sheet having the fan-mounting part of the first embodiment can be produced more readily compared to the sheet having the fan-mounting part of the second embodiment.

While the reinforcement is transparent in the second embodiment, honestly speaking, the reinforcement is desirably opaque. This is because the transparent reinforcement makes the unattractive folded cut parts visible when the fan-mounting part is seen from the inner side of an A/C cloth.

Third Embodiment

Figure 9:
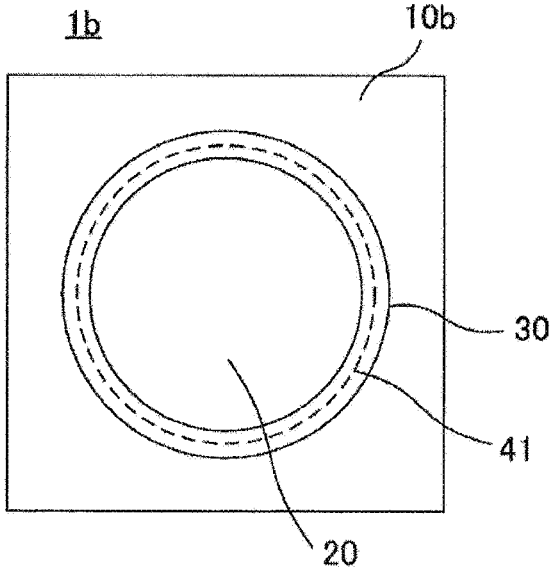
FIG. 9 (*a*) is a schematic back face view of a sheet having a fan-mounting part according to a third embodiment of the present invention, and FIG. 9 (*a*) illustrates the sheet having the fan-mounting part which is attached to a predetermined fabric part of an A/C cloth.
Figure 9:
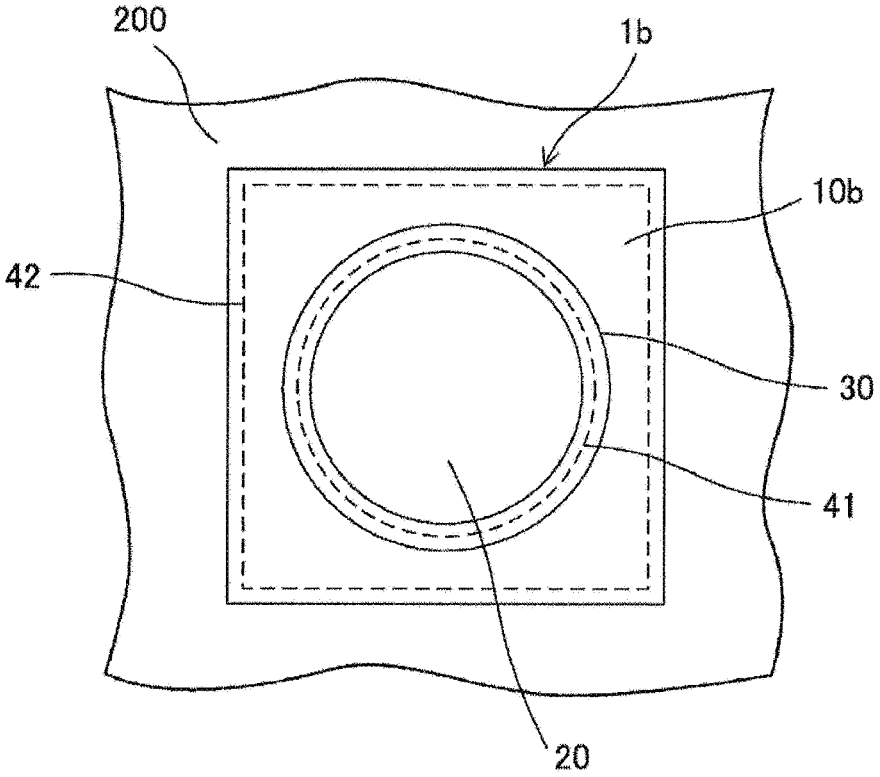

Next, a sheet having a fan-mounting part according to a third embodiment of the present invention will be described. FIG. 9 (*a*) is a schematic back face view of the sheet having the fan-mounting part according to the third embodiment of the present invention, FIG. 9 (*b*) illustrates the sheet having the fan-mounting part which is attached to a predetermined fabric part of an A/C cloth. FIG. 9 (*b*) is a view of the A/C cloth from the back side thereof. The same reference signs are denoted to components of the third embodiment that have the same function as those of the first embodiment, and the detailed description thereof is omitted.

As illustrated in FIG. 9 (*a*), the sheet having the fan-mounting part 1*b* of the third embodiment includes a sheet member 10*b*, an open hole 20 and a non-stretchable flat ring-shaped reinforcement (reinforcing section) 30. The sheet having the fan-mounting part 1*b* of the third embodiment is different from the sheet having the fan-mounting part 1 of the first embodiment in that the sheet having the fan-mounting part 1*b* is used in producing an A/C cloth or the like by the separate-sheet method. Specifically, in the first embodiment, a fabric part that is used in, for example, an A/C cloth itself is used as the sheet member 10, and the size of the sheet member 10 is therefore quite larger than the size of the fan-mounting part. In contrast, in the third embodiment, a rectangular sheet that is slightly larger than the fan mounting part is used as the sheet member 10*b* as illustrated in FIG. 9 (*a*). The other configuration is the same as that of the first embodiment.

In the third embodiment, the sheet having the fan-mounting part 1*b* is intended to be used in producing an A/C cloth or the like by the separate-sheet method, and it is possible to mass-produce the sheet having the fan-mounting parts 1*b* in a different place other than the sewing site. Therefore, by using the mass-produced sheets having the fan-mounting part 1*b*, general sewing factories which do not have equipment or skills required for forming the fan-mounting part can also produce A/C cloths and the like Specifically, to produce an A/C cloth by using the sheet having the fan-mounting part 1*b* of the third embodiment, first, a rectangular hole that is slightly smaller than the sheet member 10*b* is formed at a predetermined location in a fabric part of the A/C cloth corresponding to a mounting location of the fan. Thereafter, as illustrated in FIG. 9 (*b*), the edge part of the sheet member 10*b* is sewn to the part around the hole of the fabric part 200 so that the sheet having the fan-mounting part 1*b* is attached to the fabric part 200. In FIG. 9 (*b*), a rectangular seam 42 that is formed by the sewing work is illustrated by the dashed line. The fabric part 200 to which the sheet having the fan-mounting part 1*b* of the third embodiment is attached can be considered as a sheet having a fan-mounting part that can be used in producing an A/C cloth or the like by the own-sheet method.

The sheet having the fan-mounting part of the third embodiment has approximately the same functions and advantageous effects as the sheet having the fan-mounting part of the first embodiment.

Figure 12:
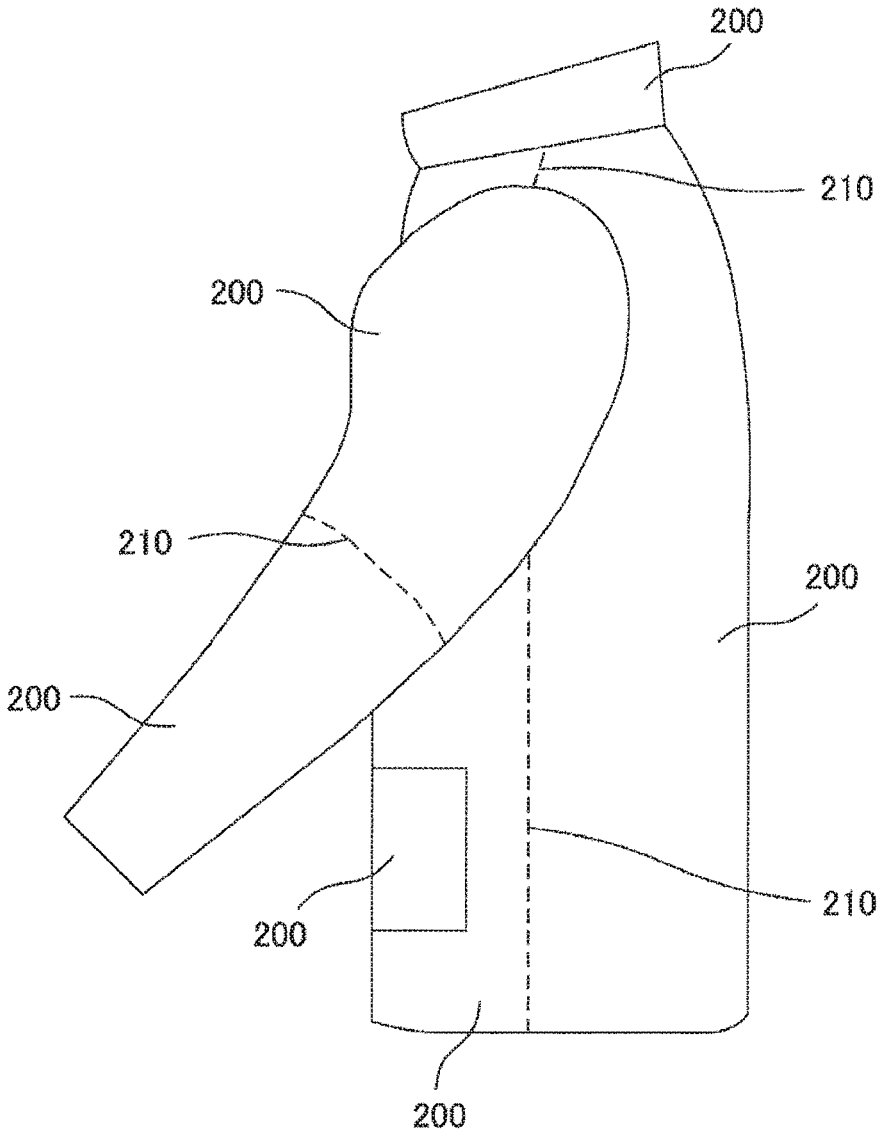
FIG. 12 is a schematic side view of a typical working cloth.

In a typical A/C cloth, fabric parts 200 are sewn together right at the sides as in the typical working cloth of FIG. 12. It is therefore difficult to form a fan-mounting part right in the side of the A/C cloth by the own-sheet method. In contrast, by the separate-sheet method, the sheet having the fan-mounting part 1*b* can be readily attached over the adjacent fabric parts 200. That is, the usage of the sheet having the fan-mounting part of the third embodiment enables providing a fan right in the side of an A/C cloth. For example, this can avoid the fan from bothering a user in a car.

The third embodiment is an example in which the sheet member is formed in a rectangular shape. However, the shape of the sheet member is not limited to a rectangular shape but may be a triangular shape, a circular shape or the like.

Variation of Third Embodiment

Figure 10:
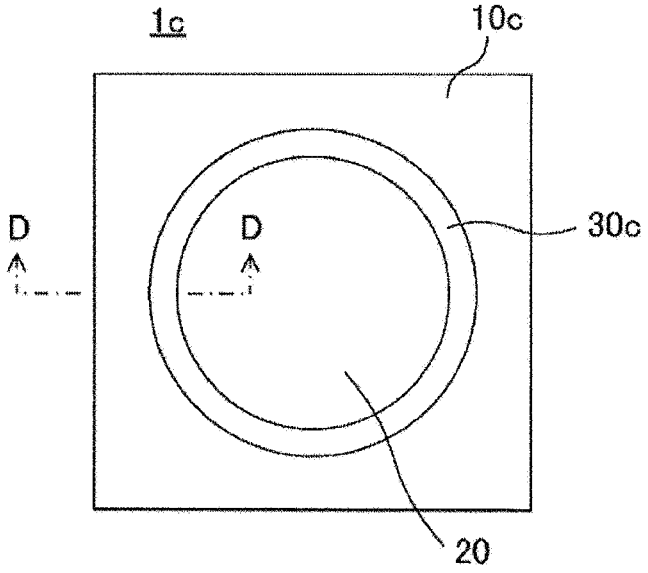
FIG. 10 (*a*) is a schematic back face view of a sheet having a fan-mounting part according to a variation of the third embodiment, and FIG. 10 (*d*) is a schematic partial cross sectional view of the sheet having the fan-mounting part taken in the direction of the arrowed line D-D.
Figure 10:
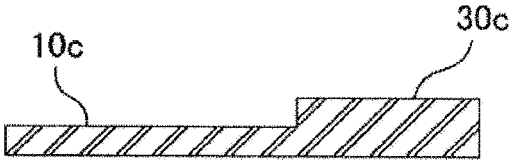

Next, a variation of the third embodiment will be described. FIG. 10 (*a*) is a schematic back face view of a sheet having a fan-mounting part according to a variation of the third embodiment, and FIG. 10 (*b*) is a schematic partial cross sectional view of the sheet having the fan-mounting part taken in the direction of the arrowed line D-D.

As illustrated in FIG. 10, the sheet having the fan-mounting part 1*c* according to the variation of the third embodiment includes a sheet member 10*c*, an open hole 20 and a non-stretchable flat ring-shaped reinforcement (reinforcing section) 30*c*. In the variation, the sheet member 10*c* and the reinforcement 30*c* are made of the same material, and the sheet member 10*c* and the reinforcement 30*c* are formed integrally with each other. Also in the sheet having the fan-mounting part 1*c*, the front face of the reinforcement 30*c* can be considered to be fixed on the edge part around the open hole 20 of the sheet member 10*c*. Specifically, the sheet member 10*c* and the reinforcement. 30*c* may be made of a plastic material. In this case, an integral molded body of the sheet member 10*c* and the reinforcement 30*c* can be readily produced by injection molding or the like.

When it is confirmed that the plastic with a certain thickness can satisfy both of the strength required for the reinforcement 30*c* and the sewability required for the sheet member 10*c*, the integral molded body of the sheet member 10*c* and the reinforcement 30*c* can be produced simply by punching a plastic sheet with the certain thickness instead of injection molding.

The other configuration of the variation is the same as that of the third embodiment, and the sheet having the fan-mounting part of the variation has approximately the same functions and advantageous effects as the sheet having the fan-mounting part of the third embodiment.

Other Embodiments

The present invention is not limited to the above-described embodiments, and various changes can be made within the features thereof.

For example, the above-described embodiments are examples in which the cylinder part of the fan has a circular outer cross section taken along a plane perpendicular to the center axis thereof. However, the cylinder part may have a rectangular outer cross section taken along a plane perpendicular to the center axis thereof. In this case, the shape of the open hole of the fan-mounting part is changed from a circular shape to a shape corresponding to the outer shape of the cylinder part. Further, the reinforcement and the sewing jig are changed to those having a shape corresponding to the outer shape of the cylinder part.

The above-described embodiments are examples in which the fan with the flange part is mounted on the sheet having the fan-mounting part of the present invention. In general, any fan can be mounted on the sheet having the fan-mounting part of the present invention, as long as it includes a fan body including cylinder part and a protrusion that is disposed on the cylinder part and protrudes in a direction approximately perpendicular to the side face of the cylinder part and an engaging member that is fitted on the outer side of the cylinder part and is thus attached to the fan body opposite the protrusion. For example, a fan may be configured such that the back face of the reinforcement is in direct contact with the protrusions when the fan is mounted.

The above-described first and second embodiments are examples in which the sheet having the fan-mounting part is used in producing an A/C cloth or the like by the own-sheet method. However, such sheet having the fan-mounting parts may also be used in producing an A/C cloth or the like by the separate-sheet method.

The above-described embodiments are examples in which the reinforcement is sewn to the sheet member in a circular shape approximately along the center of the reinforcement. However, for example, the reinforcement may be sewn to the sheet member in double lines respectively at a part near the inner edge of the reinforcement and a part near the outer edge. Alternatively, they may be sewn together in a zigzag pattern.

In the above-described embodiments, the sheet member is desirably flexible for the comfort and the like. However, in the variation of the third embodiment, when the size of the fan is small for example, it is not always necessary to use a flexible sheet member.

The above-described first and second embodiments are examples in which the sheet member is made of a normal woven fabric material. In the nature of A/C cloths, it not always required that the sheet member is permeable to moisture. Therefore, depending on the intended use of an A/C cloth, the sheet member may be made of an inexpensive material, e.g. a plastic sheet such as a vinyl sheet.

The above-described embodiments are examples in which the reinforcement is fixed on the sheet member by sewing the reinforcement to the edge part around the open hole of the sheet member. However, when the reinforcement and the sheet member are made of a weldable material, the reinforcement may be fixed on the sheet member by welding the reinforcement to the edge part around the open hole of the sheet member.

Figure 11:
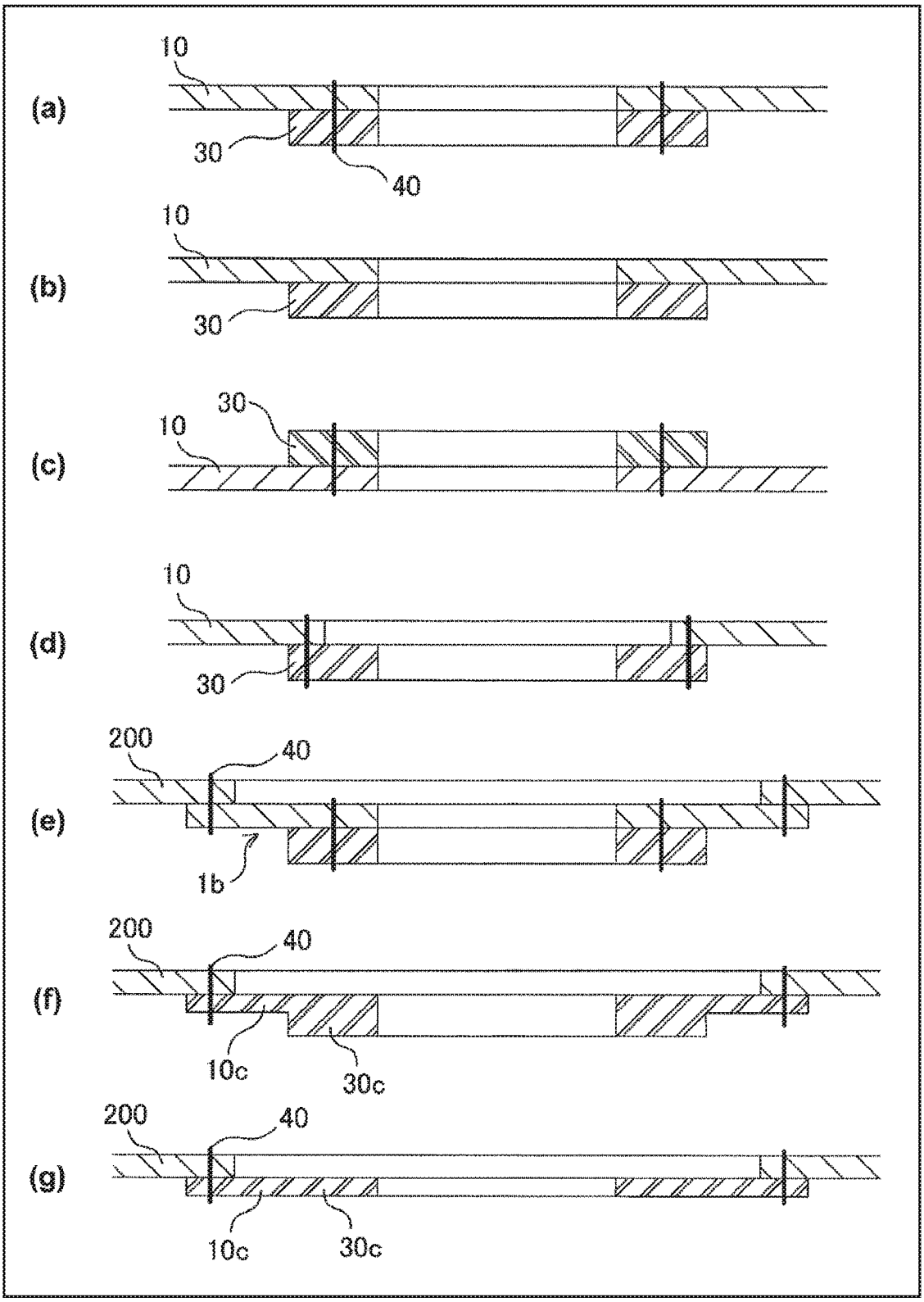
FIG. 11 illustrates representative configurations of the sheet having the fan-mounting part of the present invention.

In the foregoing, embodiments for carrying out the sheet having the fan-mounting part of the present invention are specifically described. Finally, representative configurations of the sheet having the fan-mounting part of the present invention are illustrated in FIG. 11 as a summary. FIG. 11 (*a*) to FIG. 11 (*d*) are configuration examples of the sheet having the fan-mounting part that is used in producing an A/C cloth or the like by the own-sheet method, and FIG. 11 (*e*) to FIG. 11 (*g*) are configuration examples of the sheet having the fan-mounting part that is used in producing an A/C cloth or the like by the separate-sheet method. FIG. 11 (*e*) to FIG. 11 (*g*) illustrate the sheet having the fan-mounting part which is attached to a fabric part of an A/C cloth.

A common feature of these examples is that the faces of the reinforcement other than the face fixed on the edge part of the sheet member are not covered with the sheet member but are exposed. However, the exposed front or back face of the reinforcement may be covered by some means in order to improve the appearance of an A/C cloth or the like. Also in such cases, the inner side face of the reinforcement is exposed, and the inner side face of the reinforcement is in direct contact with the outer side face of the cylinder part of the fan when the fan is mounted. In a typical case in which only one of the front and back faces of the reinforcement is fixed on the edge part of the sheet member, the reinforcement is in direct contact with the engaging member, and the inner side face of the reinforcement also is in direct contact with the outer side face of the cylinder part when the fan is mounted on the fan-mounting part.

The sheet having the fan-mounting part of FIG. 11 (*a*) corresponds to the first embodiment. The whole front face of the reinforcement 30 is covered with the sheet member 10 so that the reinforcement 30 is not visible from the front side of the sheet member 10. Further, the reinforcement 30 is sewn to the sheet member 10 with a thread 40.

In the sheet having the fan-mounting part of FIG. 11 (*b*), the reinforcement 30 and the sheet member 10 are made of a weldable material. The reinforcement 30 is fixed on the sheet member 10 by welding the reinforcement 30 to the sheet member 10.

In the sheet having the fan-mounting part of FIG. 11 (*c*), the reinforcement 30 is fixed on the front face of the sheet member 10 in the edge part around the open hole of the sheet member 10. That is, the back face of the reinforcement 30 is fixed on the edge part around the open hole of the sheet member 10. This can make the reinforcement 30 noticeable, and the reinforcement 30 can thus be utilized as a part of the design.

The sheet having the fan-mounting part of FIG. 11 (*d*) corresponds to that of FIG. 6. Only a part of the front face of the reinforcement 30 is covered with the sheet member 10, and the reinforcement 30 is partly visible from the front side of the sheet member 10.

The sheet having the fan-mounting part of FIG. 11 (*e*) corresponds to the third embodiment. The sheet having the fan-mounting part 1*b* is sewn to the fabric parts 200 with the thread 40.

The sheet having the fan-mounting part of FIG. 11 (*f*) corresponds to the variation of the third embodiment. The sheet member 10*c* and the reinforcement 30 are made of the same material, and the sheet member 10*c* and the reinforcement 30*c* are integrally formed with each other. Further, the sheet having the fan-mounting part 1*c* is sewn to the fabric parts 200 with the thread 40.

Similarly in the sheet having the fan-mounting part of FIG. 11 (*g*), the sheet member 10*c* and the reinforcement 30*c* are made of the same material, and the sheet member 10*c* and the reinforcement 30*c* are integrally formed with each other. However, the material has a certain level of strength, and the whole integral molded body is formed in a uniform thickness. It can be considered that the sheet having the fan-mounting part of FIG. 11 (*g*) is the same as the sheet having the fan-mounting part of FIG. 11 (*f*) except that the thickness of the reinforcement of is reduced to nearly 0.

The configuration examples of FIG. 11 are merely representative examples, and it should be understood that the sheet having the fan-mounting part of the present invention is not limited thereto.

INDUSTRIAL APPLICABILITY

As described above, in the sheet having the fan-mounting part of the present invention, one of the front and back faces of the reinforcing section is fixed on the edge part around the open hole of the sheet member. Therefore, unlike the prior art, forming the fan-mounting part for mounting a fan in the sheet member does not require the steps of folding the sheet member and then inserting a reinforcing section to the folded part of the sheet member and patching a back fabric to the folded part of the sheet member. That is, the fan-mounting part can be readily formed in the sheet member. Further, the non-stretchable reinforcing section can reinforce the edge part around the open hole of the sheet member by preventing the edge part from being shrunk or stretched. Therefore, even when a great force is applied between the fan and the reinforcing section or between the fan and the sheet member, the fan is less likely to come off from the fan-mounting part. As a result, the present invention is suitably applicable to air-flow mats, A/C cloths and the like.

REFERENCE SIGNS LIST

1, 1*a*, 1*b*, 1*c* Sheet having fan-mounting part
10, 10*a*, 10*b*, 10*c* Sheet member
13 Cut
14 Cut part
15 Adhesion sheet
20 Open hole
30, 30*a*, 30*c* Reinforcement (reinforcing section)
31 Inner side face
40 Thread
41, 42 Seam
60 Strengthening sheet
70 Horn of ultrasonic welder
81 Sewing jig
82 Table of sewing machine
83 Presser foot pillar of sewing machine 100 Fan
110 Fan body
111 Cylinder part
112 Flange part (protrusion)
113 Engaging hook
120 Engaging member
200 Fabric part
210 Seam

The invention claimed is:

1. A sheet having a fan-mounting part for mounting a fan, the fan comprising (i) a fan body comprising a cylinder part and a protrusion which is disposed on the cylinder part protruding in a direction substantially perpendicular to a side face of the cylinder part and (ii) an engaging member which is fitted on an outer side of the cylinder part and is thus attached to the fan body so as to be opposite the protrusion, and the sheet comprising:

a sheet member having an open hole for receiving the cylinder part of the fan; and a non-stretchable flat ring-shaped reinforcing section which has an opening formed therethrough, the opening having substantially a same shape as an outer edge of the cylinder part of the fan, one of a front face and a back face of the reinforcing section being sewn to the sheet member on an edge part around the open hole of the sheet member, and an inner side face of the opening being exposed, wherein a fray stopper is applied to the edge part around the open hole of the sheet member, wherein the fan is mounted by inserting the cylinder part into the opening of the reinforcing section and attaching the engaging member to the fan body and thereby tucking at least an inner edge part of the reinforcing section, from among the inner edge part of the reinforcing section and the edge part around the open hole of the sheet member, between the protrusion and the engaging member, whereby the inner side face of the opening opposes the side face of the cylinder part, and wherein the reinforcing section is sewn on the edge part around the open hole of the sheet member in double lines respectively at a part near an inner edge of the reinforcing section and a part near an outer edge of the reinforcing section.

2. The sheet having the fan-mounting part according to claim 1, wherein when the fan is mounted, the back face of the reinforcing section is in direct contact with the engaging member or the protrusion.

3. The sheet having the fan-mounting part according to claim 1, wherein the reinforcing section is made of a washable material selected from plastic, resin-impregnated fabric, artificial leather and non-stretchable rubber.

4. The sheet having the fan-mounting part according to claim 1, wherein the sheet member is made of woven fabric.

5. The sheet having the fan-mounting part according to claim 1, wherein the open hole has substantially a same size as the opening of the reinforcing section, and the whole front face of the reinforcing section is in contact with the edge part around the open hole of the sheet member.

6. The sheet having the fan-mounting part according to claim 1, wherein the reinforcing section is opaque.

* * * * *